US008068067B2

(12) United States Patent
Hong et al.

(10) Patent No.: US 8,068,067 B2
(45) Date of Patent: Nov. 29, 2011

(54) ANTENNA INTEGRALLY FORMED WITH CASE AND METHOD OF MANUFACTURING THE SAME

(75) Inventors: Ha Ryong Hong, Gyunggi-Do (KR); Young Suk Kim, Gunggi-Do (KR); Dae Seong Jeon, Gyunggi-Do (KR); Jae Suk Sung, Gyunggi-Do (KR)

(73) Assignee: Samsung Electro-Mechanics Co., Ltd., Gyunggi-do (KR)

( * ) Notice: Subject to any disclaimer, the term of this patent is extended or adjusted under 35 U.S.C. 154(b) by 616 days.

(21) Appl. No.: 12/183,883

(22) Filed: Jul. 31, 2008

(65) Prior Publication Data

US 2009/0051616 A1 Feb. 26, 2009

(30) Foreign Application Priority Data

Aug. 21, 2007 (KR) ..... 10-2007-0084007

(51) Int. Cl.
*H01Q 1/24* (2006.01)
*H01Q 1/40* (2006.01)

(52) U.S. Cl. ..... 343/873; 343/702

(58) Field of Classification Search ..... 343/702, 343/872, 873, 878

See application file for complete search history.

(56) References Cited

U.S. PATENT DOCUMENTS

| | | | | |
|---|---|---|---|---|
| 5,427,535 | A | 6/1995 | Sinclair | |
| 6,396,444 | B1 | 5/2002 | Goward et al. | |
| 6,423,915 | B1 | 7/2002 | Winter | |
| 7,483,728 | B2 * | 1/2009 | Kobayashi | 455/575.5 |
| 2003/0045324 | A1 | 3/2003 | Nagumo et al. | |
| 2003/0189520 | A1 * | 10/2003 | Goto et al. | 343/702 |

FOREIGN PATENT DOCUMENTS

| | | | |
|---|---|---|---|
| JP | 06216619 | | 8/1994 |
| JP | 09-321529 | A | 12/1997 |
| JP | 11177327 | | 7/1999 |
| JP | 2003234668 | | 8/2003 |
| JP | 2004-40680 | A | 5/2004 |
| JP | 2005190064 | | 7/2005 |
| JP | 2006270671 | | 10/2006 |
| JP | 2007-023878 | A | 1/2007 |
| JP | 2007-053450 | A | 1/2007 |
| KR | 10-2006-0065323 | A | 6/2006 |
| KR | 1020080036503 | A | 4/2008 |
| WO | 0039883 | | 7/2000 |

OTHER PUBLICATIONS

Notice of Office Action for Japanese Application No. 2008-202025 mailed Nov. 9, 2010.

German Office Action for Application No. 102008038303.1 mailed Mar. 22, 2011.

* cited by examiner

*Primary Examiner* — Tan Ho

(74) *Attorney, Agent, or Firm* — Lowe, Hauptman, Ham & Berner, LLP

(57) ABSTRACT

There are provided an antenna integrally formed with a case and a method of manufacturing the same. An antenna integrally formed with a case according to an aspect of the invention includes: a case unit formed of a dielectric material; a radiator integrally formed with the case unit and having terminal units extending from a radiation unit tightly contacting the surface of the case unit; vertical ribs each having an internal connection portion contacting an upper end of the terminal unit and extending downward from an inner surface of the case unit by a predetermined length; and outer connection portions provided on a board disposed adjacent to the case unit and electrically connected to individual lower ends of the internal connection portions.

17 Claims, 8 Drawing Sheets

ANTENNA INTEGRALLY FORMED WITH CASE AND METHOD OF MANUFACTURING THE SAME

CROSS-REFERENCE TO RELATED APPLICATIONS

This application claims the priority of Korean Patent Application No. 2007-0084007 filed on Aug. 21, 2007, in the Korean Intellectual Property Office, the disclosure of which is incorporated herein by reference.

BACKGROUND OF THE INVENTION

1. Field of the Invention

The present invention relates to an antenna integrally formed with a case and a method of manufacturing the same, and more particularly, to an antenna integrally formed with a case and a method of manufacturing the same that can prevent separation of a radiator provided with the case from the case and stably maintain electrical connection therebetween to increase product reliability.

2. Description of the Related Art

In general, an antenna receives radio waves coming from the outside and transmits a signal transmitted from another device to the outside.

With the rapid development of wireless communication, wireless communication terminals, such as cellular phones and personal digital assistants (PDAs), have recently come into widespread use. Size reduction of the terminals has also proceeded rapidly. Further, a large number of portable electronic devices including laptop computers and other portable electronic devices having a wireless LAN connection have a wireless communication function.

Therefore, antennas used in the electronic devices have been reduced in size. In particular, an internal antenna that is provided within a device has been widely used.

Korean Patent Laid-Open Publication No. 10-2006-0065323 (published on Jun. 14, 2006) discloses an internal antenna that can reduce the size of a terminal and improve productivity by integrally inserting a radiator into one side wall of a case having a predetermined receiving space.

The internal antenna is connected to upper ends of contact pins. Each of the contact pins is disposed in a contact pin receiving member that is provided on a board. The contact pin receiving member has therein a spring member that elastically supports the contact pin upward so as to maintain contact between the upper end of the contact pin and the radiator.

In this way, the antenna is electrically connected to the board through the contact pin.

However, an elastic force is intensively applied to terminal units of the internal antenna that make contact with the contact pins provided on the substrate. Therefore, the radiator integrally provided with the case may be separated from the surface of the case or the board and the radiator electrically connected to each other may be short-circuited due to damage to the spring member, which may cause product failures.

SUMMARY OF THE INVENTION

An aspect of the present invention provides an antenna integrally formed with a case and a method of manufacturing the same that can prevent separation of a radiator integrally provided with a case from the case due to an elastic force and stably maintain electric connection between the radiator and the case.

According to an aspect of the present invention, there is provided an antenna integrally formed with a case, the antenna including: a case unit formed of a dielectric material; a radiator integrally formed with the case unit and having terminal units extending from a radiation unit tightly contacting the surface of the case unit; vertical ribs each having an internal connection portion contacting an upper end of the terminal unit and extending downward from an inner surface of the case unit by a predetermined length; and outer connection portions provided on a board disposed adjacent to the case unit and electrically connected to individual lower ends of the internal connection portions.

The case unit may be one of front and rear cases assembled with each other to form an internal space within which the board is disposed.

The radiator may further include a protection film having one surface onto which patterns are printed by using a conductive material to form the radiation unit and the terminal units.

The protection film may be formed of a transparent material so that the radiation unit and the terminal units may be exposed to the outside through the protection film.

The terminal units may include at least one feed terminal and at least one ground terminal tightly contacting the inner surface of the case unit.

Each of the internal connection portions may include an upper body elastically contacting the terminal unit, a lower body elastically contacting the outer connection portion, and a bent portion integrally connecting the upper and lower bodies to each other and having elasticity.

Each of the outer connection portions may include an upper elastic portion bent to elastically contact the lower end of the internal connection portion and a lower fixed portion electrically connected to an RF circuit provided on the board and secured in position to the board.

According to an aspect of the present invention, there is provided a method of manufacturing an antenna integrally formed with a case, the method including: providing an upper mold having a cavity having an inner surface to which a radiator is secured in position; providing a lower mold including a protruding part including grooves in which internal connection portions are disposed; assembling the upper mold and the lower mold with each other to form a molding cavity and contact the radiator and the internal connection portions to each other; molding a case unit including the radiator integrally provided thereon by injecting a dielectric resin material into the molding cavity, and vertical ribs having therein the internal connection portions integrally provided thereon and protruding from an inner surface of the case by a predetermined length; and separating the case unit from the upper and lower molds.

The radiator may include a radiation unit and terminal units by forming conductive patterns on a protection film.

The radiation unit may be exposed to the outside through the protection film having transparency.

The protection film may tightly contact the inner surface of the upper mold and is secured in position.

A portion of an upper end of each of the internal connection portions inserted and disposed in the grooves of the lower mold may protrude upward from the protruding part.

The internal connection portions disposed in the grooves may be compressed by reducing a distance between the upper mold and the lower mold to maintain contact between the terminal units of the radiator and the upper ends of the internal connection portions.

The method may further include disposing the case unit having the radiator integrally provided thereon to be adjacent to the board and contacting the outer connection portions provided on the board and the internal connection portions of the vertical ribs.

BRIEF DESCRIPTION OF THE DRAWINGS

The above and other aspects, features and other advantages of the present invention will be more clearly understood from the following detailed description taken in conjunction with the accompanying drawings, in which.

DETAILED DESCRIPTION OF THE PREFERRED EMBODIMENT

Exemplary embodiments of the present invention will now be described in detail with reference to the accompanying drawings.

Figure 1:
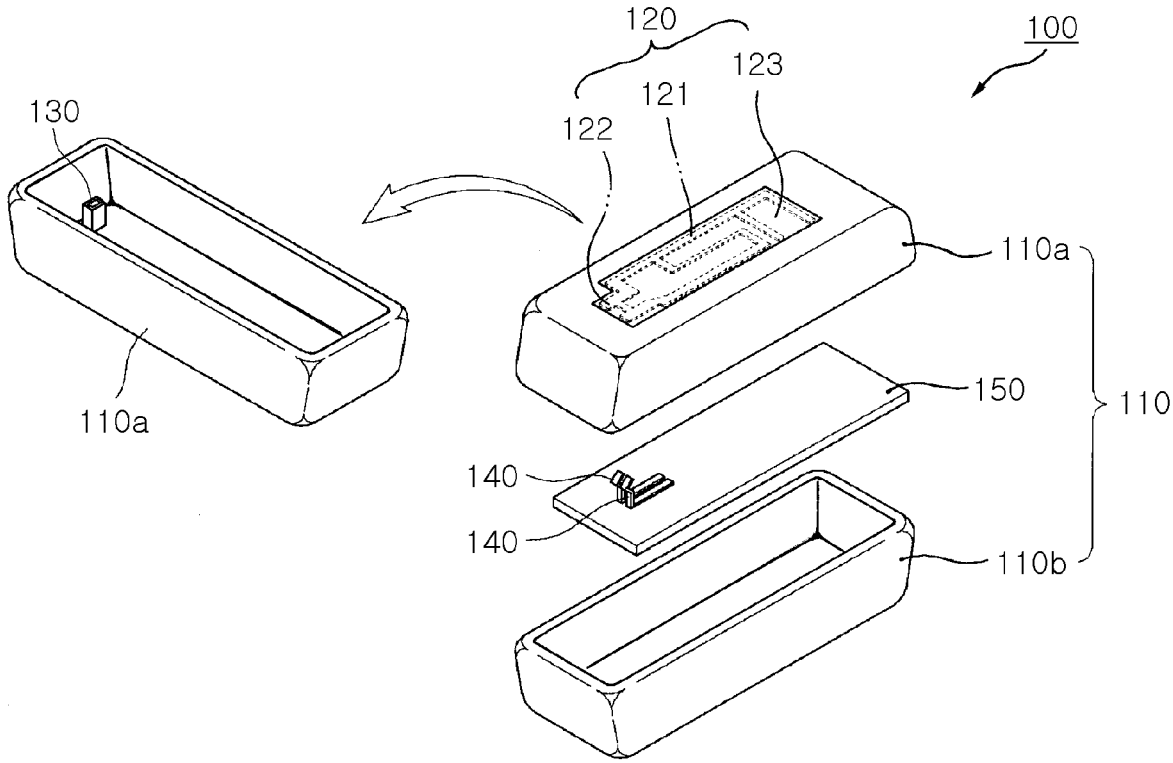
FIG. 1 is an exploded perspective view illustrating an antenna integrally formed with a case according to an exemplary embodiment of the present invention.
Figure 2:
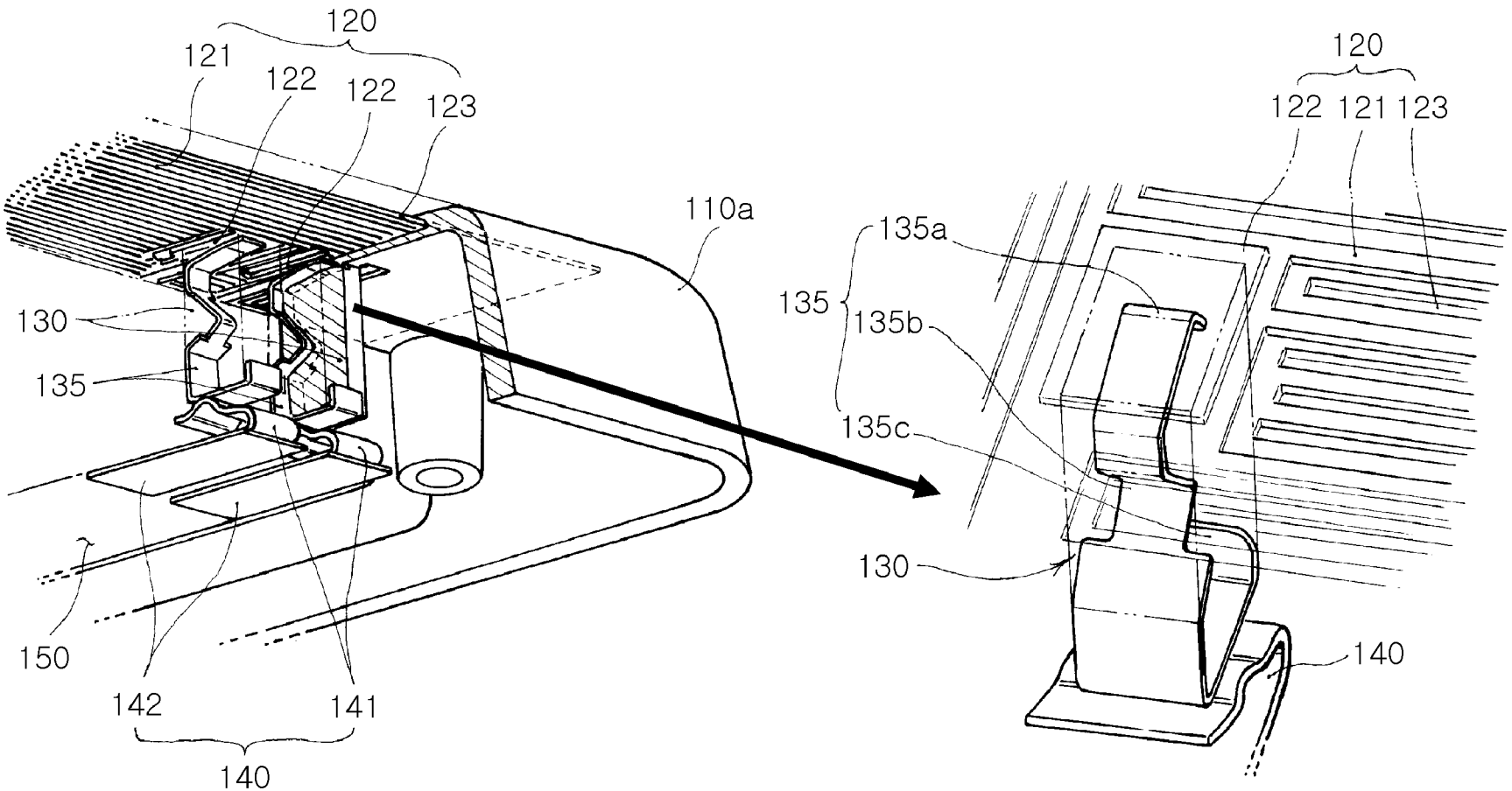
FIG. 2 is a perspective view illustrating the antenna integrally formed with the case according to the exemplary embodiment of the present invention.
Figure 3:
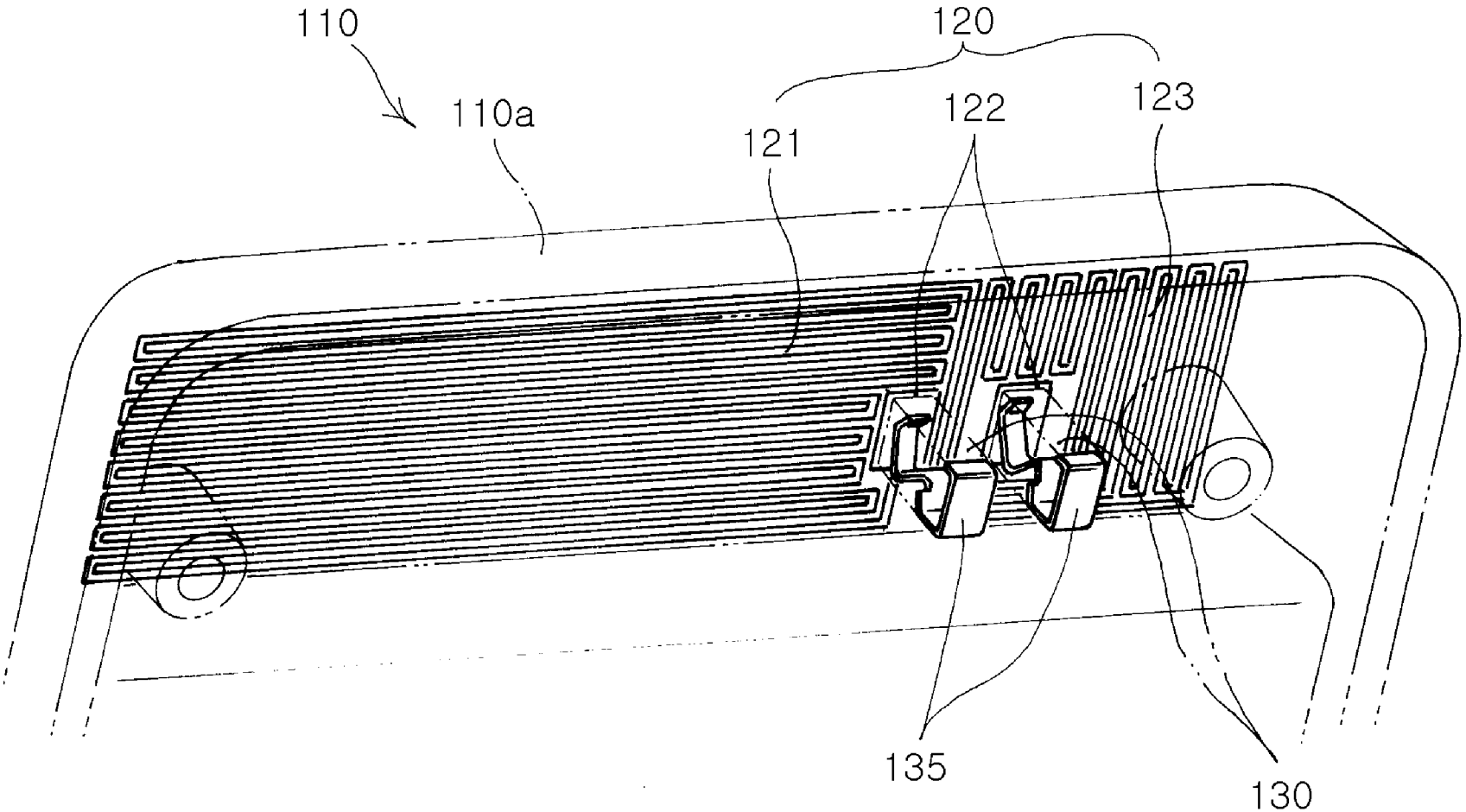
FIG. 3 is a bottom perspective view illustrating the antenna integrally formed with the case according to the exemplary embodiment of the present invention.
Figure 4:
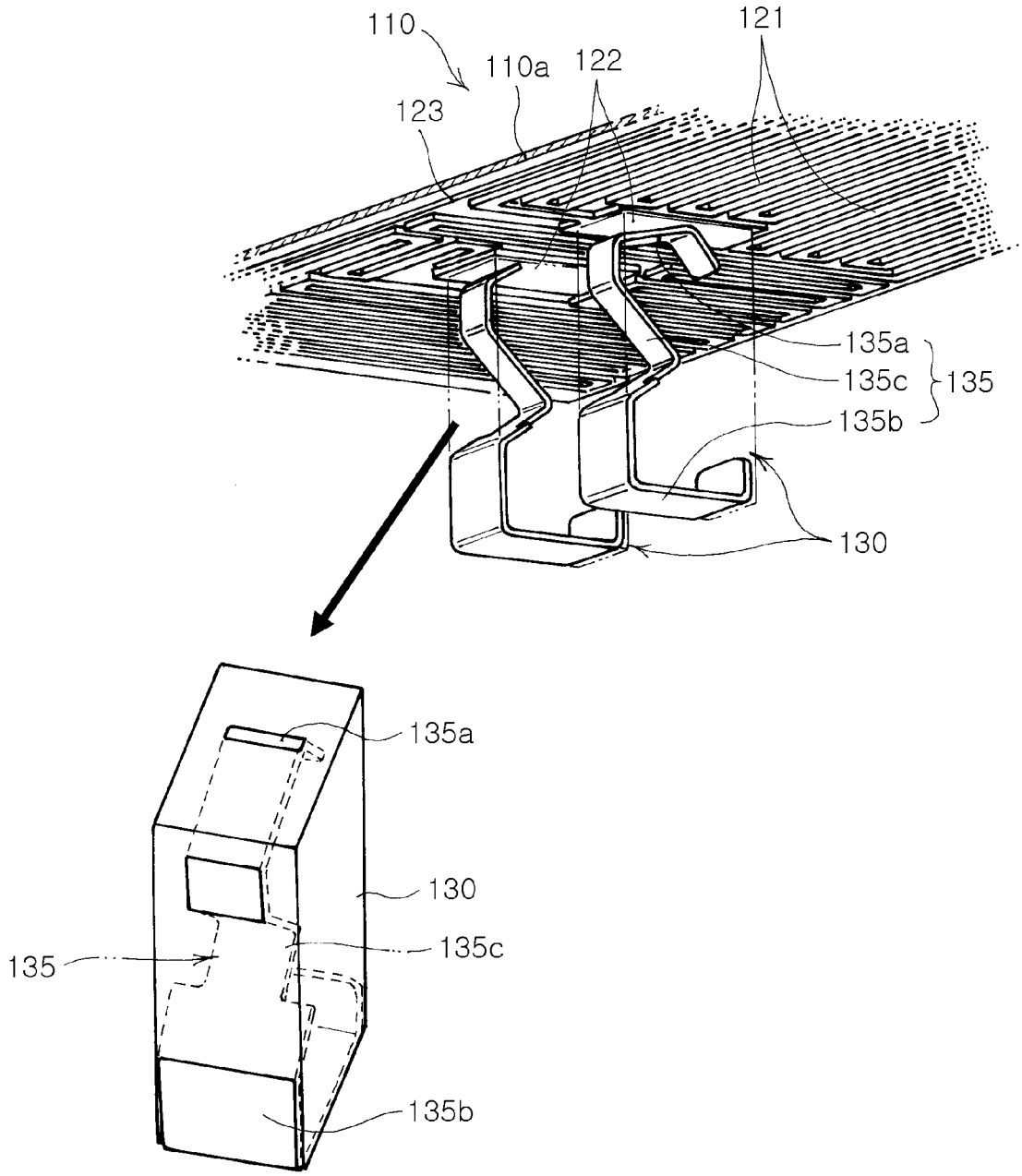
FIG. 4 is a detailed view illustrating a radiator and vertical ribs used in the antenna integrally formed with the case according to the exemplary embodiment of the present invention.

FIG. 1 is an exploded perspective view illustrating an antenna integrally formed with a case according to an exemplary embodiment of the present invention. FIG. 2 is a perspective view illustrating the antenna integrally formed with a case according to the exemplary embodiment of the present invention. FIG. 3 is a bottom perspective view illustrating the antenna integrally formed with a case according to the exemplary embodiment of the present invention. FIG. 4 is a detailed view illustrating a radiator and vertical ribs used in the antenna integrally formed with a case according to the exemplary embodiment of the invention.

As shown in FIGS. 1 to 4, an antenna 100 according to an exemplary embodiment of the invention includes a case unit 110, a radiator 120 integrally provided with the case unit 110, vertical ribs 130, and external connection portions 140 provided on a board 150.

The case unit 110 is a structure that is molded by using a resin material formed of a dielectric substance.

The case unit 110 may include a front case 110*a* and a rear case 110*b* that are assembled with each other to dispose the board 150 therein. A plurality of electronic components (not shown), such as active devices and passive devices, and an RF circuit (not shown) electrically connected to the external connection portions 140 are mounted onto the board 150 at predetermined mounting positions.

The radiator 120 includes a radiation unit 121 and terminal units 122. The radiation unit 121 and the terminal units 122 may be formed in such a way that a conductive material is printed or deposited in predetermined patterns on the surface of any one of front and rear cases 110*a* and 110*b* that form the case unit 110.

Alternatively, the radiation unit 121 and the terminal units 122 may be formed in such a way that a conductive material is printed or deposited in predetermined patterns on one surface of a protection film 123 that is formed of a transparent material. The protection film 123 is integrally formed on the surface of the case unit 110. The radiation unit 121 and the terminal units 122 are exposed to the outside through the protection film 123.

Preferably, the protection film 123 lies in almost the same plane as the outer surface of the case unit 110.

Preferably, the protection film 123 is formed of a transparent polymer material. More preferably, the protection film 123 is formed of any one of PET (Polyethylene Terephthalate), PP (Polypropylene), and PE (Polyethylene).

The radiator 120 including the radiation unit 121 and the terminal units 122 is formed of the conductive material, and performs physical signal input and output of signals by generating an induced current by electromagnetic waves or by generating electromagnetic waves by an electrical signal.

Here, when a signal used in the radiator 120 has a wavelength of $\lambda$, the radiation unit 121 preferably has an electrical length corresponding to $\lambda/4$, and a predetermined slit is formed in the radiation unit 121.

The slit changes the entire electrical length of the radiator 120 and generates electrical coupling in the radiator 120. Therefore, by extending the bandwidth of the antenna or introducing an additional resonance frequency, a broadband or multiband antenna can be realized.

The drawings are given and the description has been made of a case in which the terminal units 122 are formed of two terminals, that is, one ground terminal and one feed terminal that extending from the radiation unit 121. However, the present invention is not limited thereto, and the terminal units 122 may have more than two terminals.

Here, each of the number of vertical ribs 130 and the number of external connection portions 140 needs to be the same as the number of terminal units 122.

Each of the vertical ribs 130 is a protruding member that extends from the inner surface of the case unit 110 toward the board 150 by a predetermined length when the case unit 110 is molded. The vertical rib 130 has therein an internal connection portion 135 that is integrally formed with the vertical rib 130. The internal connection portion 135 has an upper end that corresponds to the terminal unit 122 and contacts the terminal unit 122 and a lower end that corresponds to the board 150, is exposed to the outside through the bottom of the vertical rib 130, and contacts the external connection portion 140.

The vertical rib 130 is formed of the same material as the case unit 110 and is molded integrally with the case unit 110 when the case unit 110 is molded.

The drawings are given and the description has been made of a case in which the vertical ribs 130 are integrally formed with the front case 110*a* on which the radiator 120 is provided. However, the present invention is not limited thereto. When the radiator 120 is provided on the rear case 110*b*, the vertical ribs 130 may be provided on the rear case 110*b*.

Each of the internal connection portions 135 includes an upper body 135*a*, a lower body 135*b*, and a bent portion 135*c*. The upper body 135*a* is bent to elastically make line contact with the terminal unit 122. The lower body 135*b* is bent to elastically make contact with the external connection portion 140. The bent portion 135*c* integrally connects the upper and lower bodies 135*a* and 135*b* and has an elastic force.

Preferably, the internal connection portion 135 is formed of a metal having excellent workability and high conductivity so that an electrical contact with the radiator 120 is stably ensured and the upper and lower bodies 135*a* and 135*b* and the bent portion 135*c* can be more easily manufactured.

Further, the external connection portion 140 is formed of a conductive elastic member. While the external connection portions 140 are electrically connected to the RF circuit (not shown) of the board 150 disposed adjacent to the case unit 110, the external connection portions 140 come in contact with and are electrically connected to the lower ends of the internal connection portions 135 integrally formed with the vertical ribs 130 when the case unit 110 and the board 150 are coupled to each other.

When the front case 110*a* and the board 150 are coupled corresponding to each other, upper free ends of the external connection portions 140 contact the internal connection portions 135 that are integrally formed with the vertical ribs 130 each of which extends from the inside of the front case 110*a* by the predetermined length. In this way, the radiator 120, the internal connection portion 135, and the external connection portion 140 form one circuit.

At this time, each of the external connection portions 140 includes an upper elastic portion 141 and a lower fixed portion 142. The upper elastic portion 141 is bent to elastically contact the lower end of the internal connection portion 135. The lower fixed portion 142 extends from the upper elastic portion 141, is electrically connected to the RF circuit provided on the board 150, and is secured in position to the board 150.

FIGS. 5A, 5B, 5C, and 5D are views illustrating processes of manufacturing the antenna integrally formed with a case according to an exemplary embodiment of the present invention.

A radiator 120 that has a radiation unit 121 and terminal units 122 formed by depositing or printing predetermined patterns onto the surface of a protection film 123 having transparency is provided.

An upper mold 171 having a cavity 171*a* that has an opened lower part in a predetermined size is provided. A lower mold 172 having a protruding part 172*a* that protrudes at an upper surface thereof corresponding to the cavity 171*a* by a predetermined height is provided.

Figure 5A:
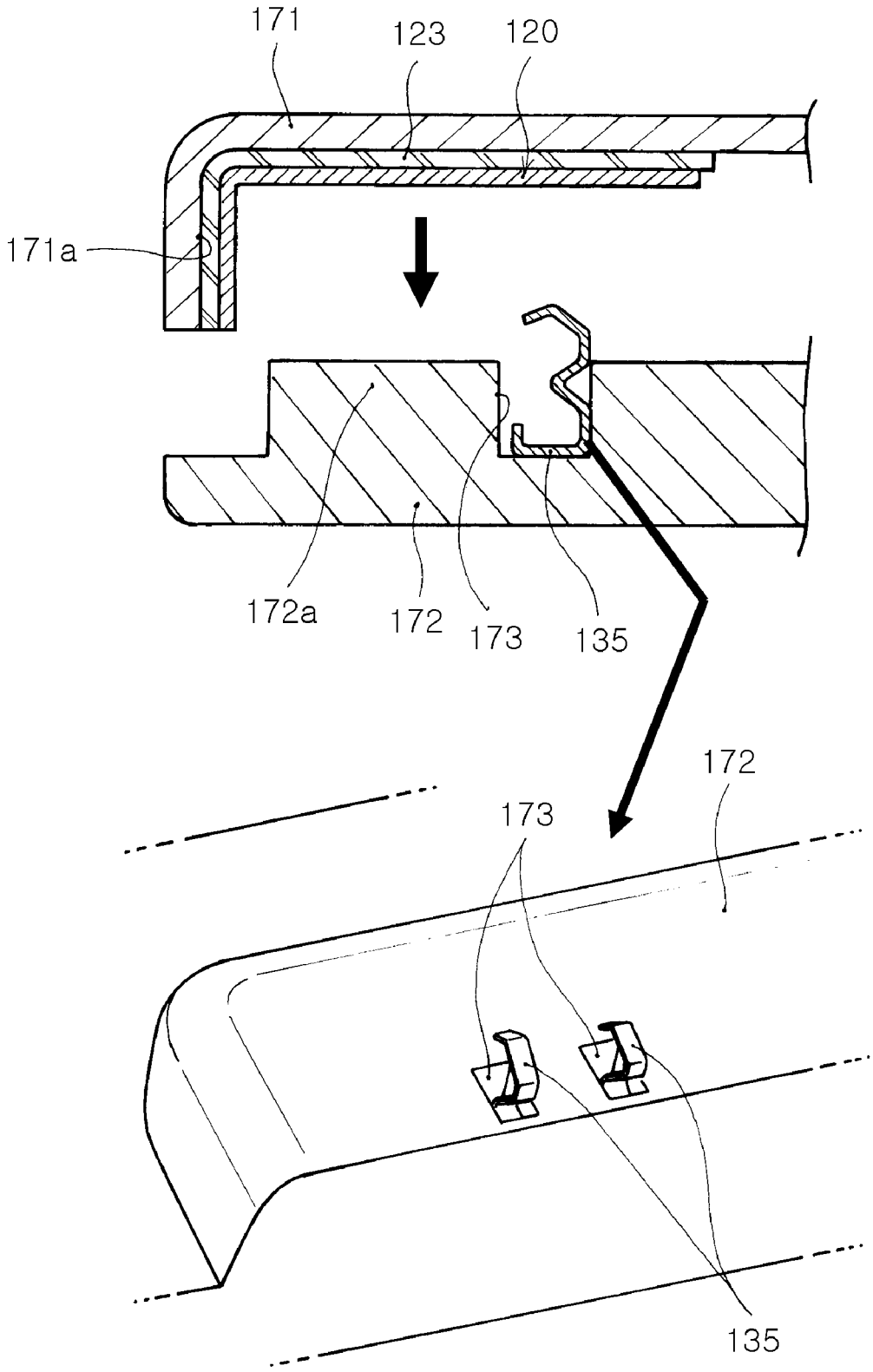
FIGS. 5A, 5B, 5C, and 5D are views illustrating an antenna integrally formed with a case according to another exemplary embodiment of the present invention.

As shown in FIG. 5A, the radiator 120 needs to be secured in position against movement caused by a resin material forcibly injected into the cavity 171*a* of the upper mold 171 during injection molding.

The protection film 123 of the radiator 120 tightly contacts an inner surface of the cavity 171*a* of the upper mold 171. The radiation unit 121 and the terminal units 122 formed at the surface of the protection film 123 are exposed to the outside toward the cavity 171*a*.

Grooves 173 having a predetermined depth are formed in the protruding part 172*a* by depressing the protruding part 172*a* of the lower mold 172 such that internal connection portions 135 are inserted and disposed in the grooves 173.

Here, the predetermined depth of each of the groove 173 is smaller than a height of the internal connection portion 135. When the internal connection portion 135 is inserted and disposed in the groove 173 of the lower mold 172, a portion of an upper end of the internal connection portion 135 inserted and disposed in the groove 173 protrudes above the top surface of the lower mold 172.

Figure 5B:
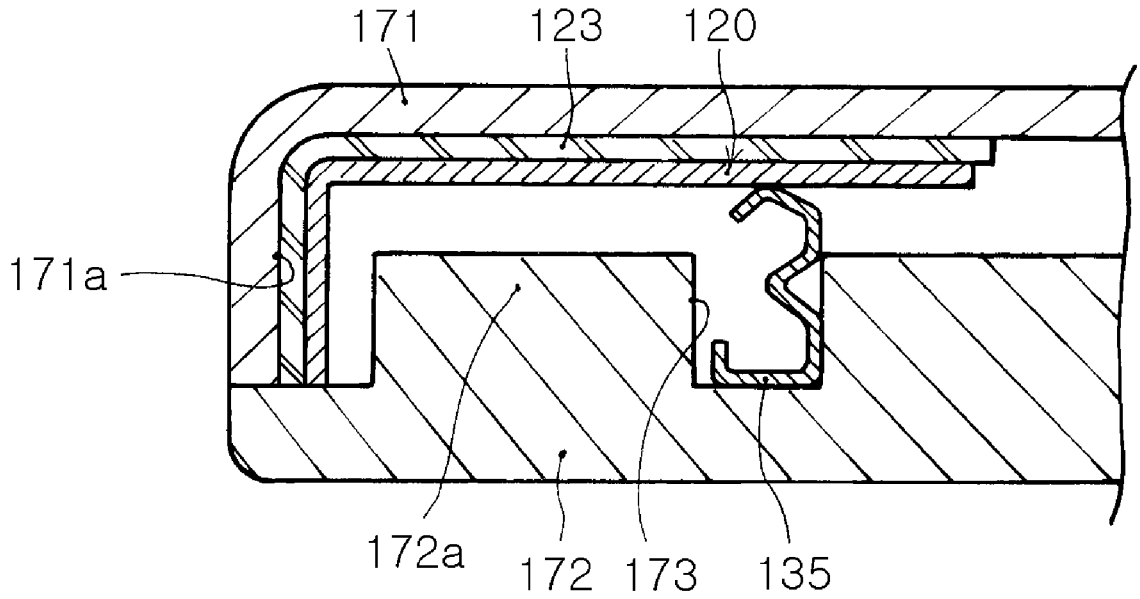

At this time, as shown in FIG. 5B, the upper mold 171 and the lower mold 172 are assembled with each other. The protruding part 172*a* is inserted into the corresponding cavity 171*a* of the upper mold 171, and at the same time, the radiator 120 tightly fixed to the inner surface of the upper mold 171 makes contact with the upper end of the internal connection portion 135 inserted and disposed in the groove 173 of the protrusion 172*a*.

That is, when the upper mold 171 and the lower mold 172 are assembled with each other, a molding cavity having a predetermined size is formed and each of the terminal units 122 of the radiator 120 makes contact with the upper end of the internal connection portion 135.

At this time, when the distance between the upper and lower molds 171 and 172 is reduced, each of the internal connection portions 135 is compressed to generate elasticity to maintain contact between the terminal unit 122 of the radiator 120 and the upper end of the internal connection portion 135.

Figure 5C:
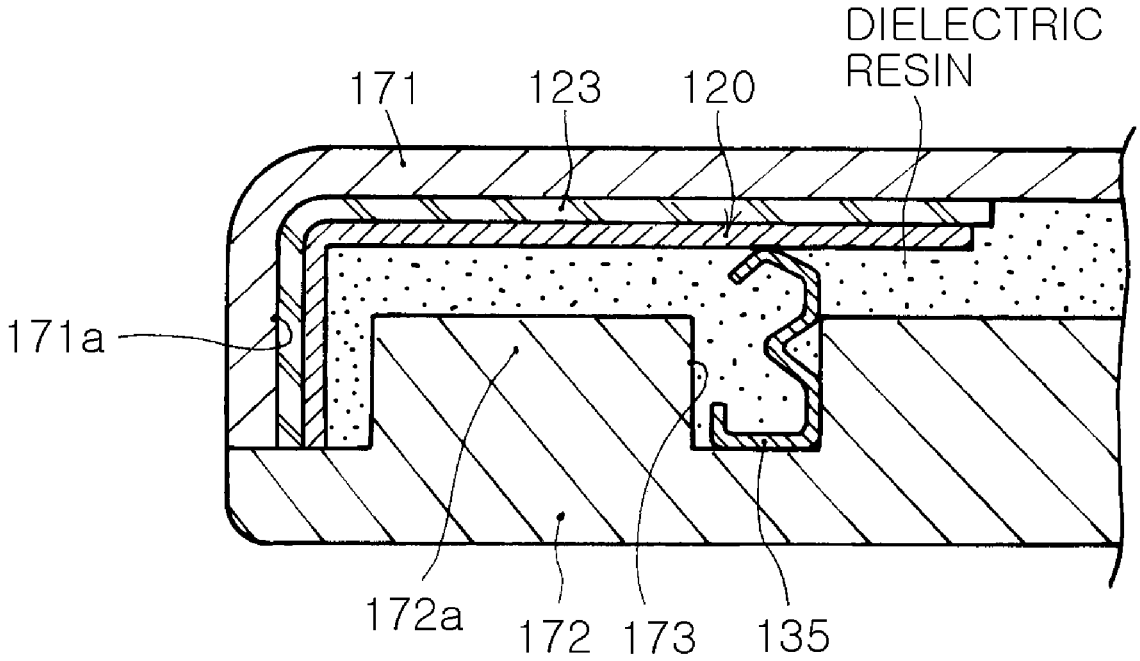

Then, as shown in FIG. 5C, when dielectric resin material is injected into the molding cavity through an injection hole (not shown), the dielectric resin material fills in the molding cavity and the grooves 173 to thereby mold a case unit 110. The case unit 110 has the radiator 120 integrally attached thereto and vertical ribs 130 integrally formed with the internal connection portions 135 that contact the terminal units 122 of the radiator 120 is molded.

Here, since the radiator 120 is tightly fixed to the inner surface of the upper mold 171, even when a high-pressure dielectric resin material is injected into the molded cavity formed between the upper and lower molds 171 and 172, the initial fixed position of the radiator 120 is not changed.

Figure 5D:
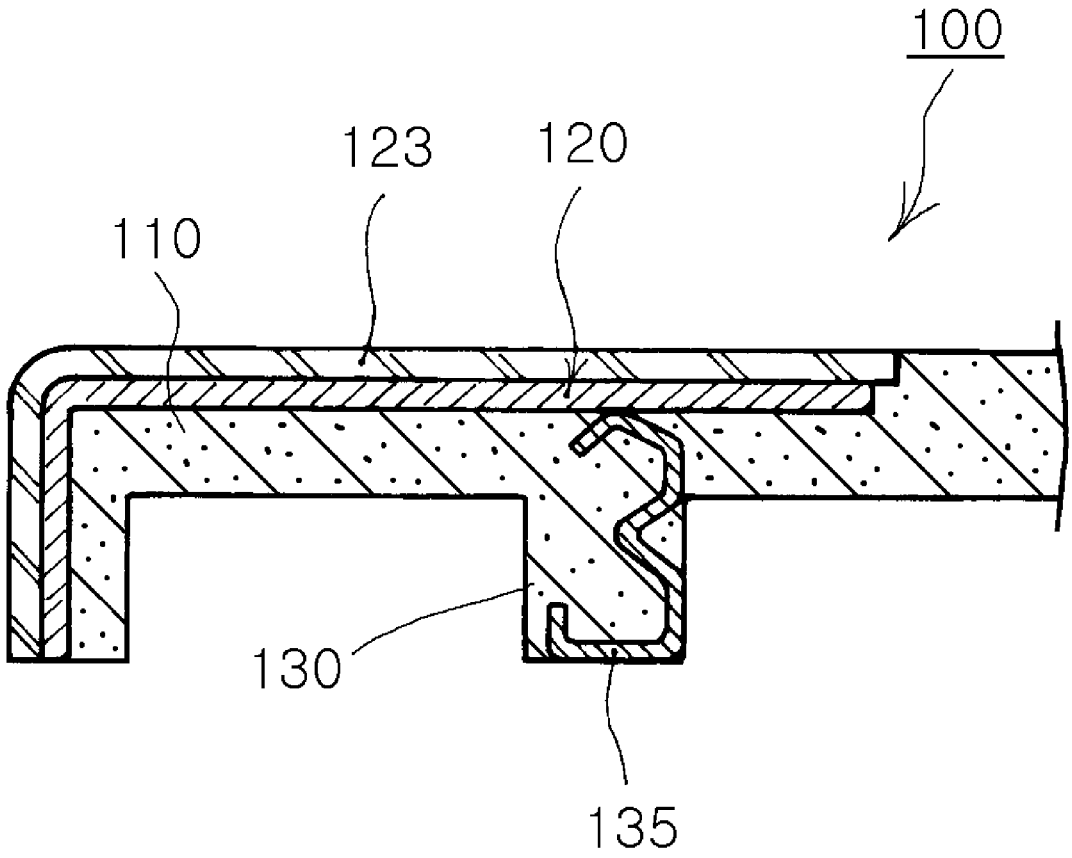

The dielectric resin material injected into the molding cavity between the upper and lower molds 171 and 172 is cured after a predetermined period of time. Then, the upper and lower molds 171 and 172 are separated from each other. As shown in FIG. 5D, the radiator 120 is integrally attached to the case unit 110, the vertical ribs 130 extending downward by the predetermined length are integrally formed with the inner surface of the case unit 110, and the internal connection portions 135 each having an upper end in contact with the terminal unit 122 of the radiator 120 and a lower end exposed to the outside are integrally formed with the vertical ribs 130.

When a board 150 having external connection portions 140 on an upper surface thereof is disposed adjacent to the case unit 110, since the upper elastic portion 141 of each of the external connection portions 140 elastically contacts the internal connection portion 135 that is exposed to the outside through the bottom of the vertical rib 130, the internal connection portions 135 and an RF circuit electrically connected to the external connection portions 140 form one circuit together with the radiator 120.

Further, since the radiation unit 121 and the terminal units 122 provided on the case unit 110 are exposed to the outside through the protection film 123, it is possible to prevent short circuit or damage to the radiation unit 121 caused by the environment.

As set forth above, according to the exemplary embodiments of the invention, the radiator is integrally formed with the case unit, the internal connection portions connected to the terminal parts of the radiator are provided to the vertical ribs extending from the internal surface of the case unit, such that the radiator, the internal connection portions, and the outer connection portions make contact with each other to thereby configure one circuit. Therefore, separation of the radiator attached to the case unit is prevented, and electrical connection between the case and the radiator is stably maintained. Accordingly, product failures can be prevented and product reliability can be improved.

While the present invention has been shown and described in connection with the exemplary embodiments, it will be apparent to those skilled in the art that modifications and variations can be made without departing from the spirit and scope of the invention as defined by the appended claims.

What is claimed is:

1. An antenna comprising:

a case unit formed of a dielectric material;

a radiator integrally formed with the case unit and having a radiation unit and terminal units, the terminal units extending from the radiation unit and tightly contacting an inner surface of the case unit;

vertical ribs extending downward from the inner surface of the case unit by a predetermined length and each having an internal connection portion integrally formed therein, the internal connection portion having an upper end contacting a corresponding one of the terminal units; and outer connection portions provided on a board disposed adjacent to the case unit and electrically connected to individual lower ends of the internal connection portions, respectively.

2. The antenna of claim 1, wherein the case unit is any one of a front case and a rear case assembled with each other to form an internal space within which the board is disposed.

3. The antenna of claim 1, wherein the radiator further comprises a protection film having one surface onto which patterns of a conductive material are printed to form the radiation unit and the terminal units.

4. The antenna of claim 3, wherein the protection film is formed of a transparent material so that the radiation unit and the terminal units are exposed to the outside through the protection film.

5. The antenna of claim 1, wherein the terminal units comprise at least one feed terminal and at least one ground terminal tightly contacting the inner surface of the case unit.

6. The antenna of claim 1, wherein each of the internal connection portions comprises an upper body elastically contacting the respective terminal unit, a lower body elastically contacting the respective outer connection portion, and a bent portion formed between the upper body and the lower body and integrally connecting the upper and lower bodies, the bent portion being arranged to impart elasticity to the internal connection portion.

7. The antenna of claim 1, wherein each of the outer connection portions comprises an upper elastic portion bent to elastically contact a corresponding one of the lower ends of the internal connection portions and a lower fixed portion electrically connected to a radio frequency (RF) circuit provided on the board and secured to the board.

8. A method of manufacturing an antenna having a radiator integrally formed with a case unit, the method comprising:

assembling an upper mold and a lower mold with each other to form a molding cavity, the upper mold including a cavity having an inner surface to which the radiator is secured, the lower mold including a protruding part having grooves in which internal connection portions are placed, and the radiator and the internal connection portions being positioned to contact with each other;

molding the case unit having the radiator integrally provided thereon by injecting a dielectric resin material into the molding cavity, and vertical ribs having therein the internal connection portions integrally provided thereon and protruding from an inner surface of the case unit by a predetermined length; and separating the case unit from the upper and lower molds.

9. The method of claim 8, wherein the radiator comprises a radiation unit and terminal units by forming conductive patterns on a protection film.

10. The method of claim 9, wherein the protection film is transparent, and the radiation unit is exposed to the outside through the protection film.

11. The method of claim 9, wherein the protection film tightly contacts the inner surface of the upper mold and is secured in position.

12. The method of claim 9, wherein the internal connection portions disposed in the grooves are compressed by reducing a distance between the upper mold and the lower mold to maintain contact between the terminal units of the radiator and upper ends of the internal connection portions.

13. The method of claim 8, wherein a portion of an upper end of each of the internal connection portions is inserted and disposed in the grooves of the lower mold, and protrudes upward from the protruding part.

14. The method of claim 8, further comprising:

disposing the case unit having the radiator integrally provided thereon to be adjacent to a board and contacting outer connection portions provided on the board and the internal connection portions of the vertical ribs.

15. An antenna, comprising:

a case unit comprising a dielectric material;

a radiator integrally formed with the case unit and having a radiation unit and a terminal unit extending from the radiation unit; and a vertical rib extending downward from an inner surface of the case unit by a predetermined length and having an internal connection portion integrally formed therein, the internal connection portion having an upper end contacting the terminal unit and a lower end being arranged to be connectable with a conductive feature.

16. The antenna of claim 15, wherein the radiator further comprises a protection film having one surface onto which patterns of a conductive material are printed to form the radiation unit and the terminal unit.

17. The antenna of claim 15, wherein the internal connection portion comprises an upper body elastically contacting the terminal unit, a lower body for elastically contacting the conductive feature, and a bent portion formed between the upper body and the lower body and integrally connecting the upper and lower bodies, the bent portion being arranged to impart elasticity to the internal connection portion.

* * * * *